US007119756B2

(12) United States Patent
Ohba

(10) Patent No.: US 7,119,756 B2
(45) Date of Patent: Oct. 10, 2006

(54) RADAR HORN ANTENNA

(75) Inventor: Tetsuya Ohba, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 199 days.

(21) Appl. No.: 10/395,224

(22) Filed: Mar. 25, 2003

(65) Prior Publication Data

US 2004/0066349 A1 Apr. 8, 2004

(30) Foreign Application Priority Data

Oct. 7, 2002 (JP) ..... P2002-293980

(51) Int. Cl.
*H01Q 13/00* (2006.01)

(52) U.S. Cl. ..... 343/786; 343/772

(58) Field of Classification Search ..... 343/786, 343/772, 805, 794

See application file for complete search history.

(56) References Cited

U.S. PATENT DOCUMENTS 3,924,237 A * 12/1975 Fletcher et al. ..... 343/786
4,633,264 A * 12/1986 Imazeki et al. ..... 343/786
5,017,936 A * 5/1991 Massey ..... 343/773
5,258,768 A * 11/1993 Smith ..... 343/786
5,640,168 A * 6/1997 Heger et al. ..... 343/786
5,959,591 A * 9/1999 Aurand ..... 343/786
6,275,196 B1 * 8/2001 Bobier ..... 343/840
6,405,058 B1 * 6/2002 Bobier ..... 455/562.1
6,819,298 B1 * 11/2004 Jung ..... 343/782

FOREIGN PATENT DOCUMENTS

| | | |
|---|---|---|
| JP | 49-25345 | 3/1974 |
| JP | 62-89820 U | 6/1987 |
| JP | 62-117817 U | 7/1987 |
| JP | 2-217003 A | 8/1990 |
| JP | 2001-201557 | 7/2001 |

* cited by examiner

*Primary Examiner*—Shih-Chao Chen
*Assistant Examiner*—Minh Dieu A
(74) *Attorney, Agent, or Firm*—Sughrue Mion, PLLC

(57) ABSTRACT

A radar horn antenna in which, to reduce or remove unnecessary echo from a specific angular range such as ground clutter, divergence in axial direction of a horn antenna 8 accommodated in a casing and covered with a radome is asymmetrical with respect to the axis of the horn antenna so that a maximum radiation direction in a radiation pattern of the horn antenna is deviated from front to another and/or gain in the specific angular range is controlled.

8 Claims, 4 Drawing Sheets

RADAR HORN ANTENNA

BACKGROUND OF THE INVENTION

1. Field of the Invention

The present invention relates to a radar horn antenna and, more particularly, to a radar horn antenna that is mounted on a vehicle and detects an object.

2. Description of the Related Art

Hitherto, on-vehicle radar used in automatic drive and collision prevention of a vehicle has a disadvantage that it is difficult to detect an echo from a target due to reception of radio waves reflected from a road surface, i.e., due to influence of so-called ground clutter, depending on radiation pattern of a transmission/reception antenna and on how the radar antenna is mounted on the vehicle.

The Japanese Patent Publication (unexamined) No. 2001-201557 proposed a countermeasure to overcome such ground clutter incidental to the on-vehicle radar. In this known countermeasure, the radar antenna transmitting and receiving radio waves is accommodated in a casing for fixing the radar antenna, and a radome (cover) for protecting the radar antenna from hit stone, rain, snow, etc. is disposed at the front side of the radar antenna. The radar sensor constructed as described above is fixed onto the vehicle with a metal bracket. Lower portion of the metal bracket is provided with a shielding member projecting forward from a lower portion of the radar sensor. The shielding member reflects and attenuates side lobe radiated from the radar antenna, and this makes it possible to reduce ground clutter caused by the side lobe.

However, in the conventional on-vehicle radar of foregoing structure, a problem exists in that the radar becomes large and heavy as a whole. Moreover, another problem exists in that any desired radiation pattern is disturbed by radio waves reflected from the shielding member projecting forward at the lower portion of the radar antenna.

SUMMARY OF THE INVENTION

The present invention was made to solve the above-discussed problems and provides a small and light radar horn antenna capable of reducing and removing an echo from under.

To accomplish the foregoing object, in a radar horn antenna according to the invention, divergence of horn part in axial direction of a horn antenna is formed asymmetrical with respect to the axis of the mentioned horn antenna so that maximum radiation direction in radiation pattern of the mentioned horn antenna is deviated from front to another and/or gain in a specific angular range is controlled.

As a result, in the horn antenna of above construction, it is possible to deviate the maximum radiation direction in radiation pattern of the horn antenna from front to another and/or control the gain in a specific angular range with the use of a simple structure without changing mounting angle of the horn antenna and enlarging diameter of the opening.

In another radar horn antenna according to the invention, horn part is composed of four sidewalls communicating to a feeding wave-guide tube part, and at least one of the four sidewalls is composed of a flexible conductor film, and in which the mentioned divergence in axial direction of the antenna is adjusted by changing a bending angle of the mentioned conductor film bending from an end of the mentioned wave-guide tube part.

As a result, in the horn antenna of above construction, it is possible to continuously change the divergence of the antenna opening.

The other objects and features of this invention will become understood from the following description with reference to the accompanying drawings.

DETAILED DESCRIPTION OF THE PREFERRED EMBODIMENTS

Embodiment 1

Figure 1:
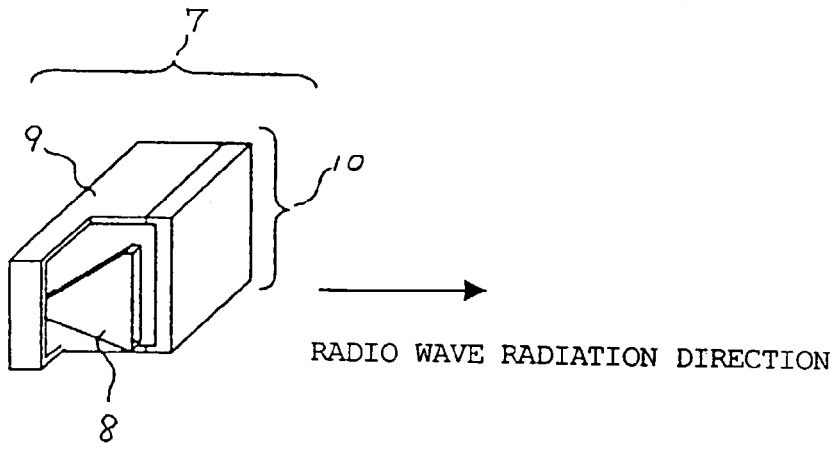
FIG. 1 is a partially cutaway perspective view of an on-vehicle radar sensor using a horn antenna according to Embodiment 1 of the invention.

FIG. 1 is a partially cutaway perspective view showing a radar sensor in which a horn antenna according to Embodiment 1 of the invention is adopted. Referring to FIG. 1, a horn antenna 8 according to the invention is accommodated in a casing 9 fixed onto a vehicle, and a radome (a cover) 10 for covering an opening of the horn antenna 8 and protecting the horn antenna 8 from hit stone, rain, snow, etc. is disposed at the front side of the horn antenna 8.

Figure 2:
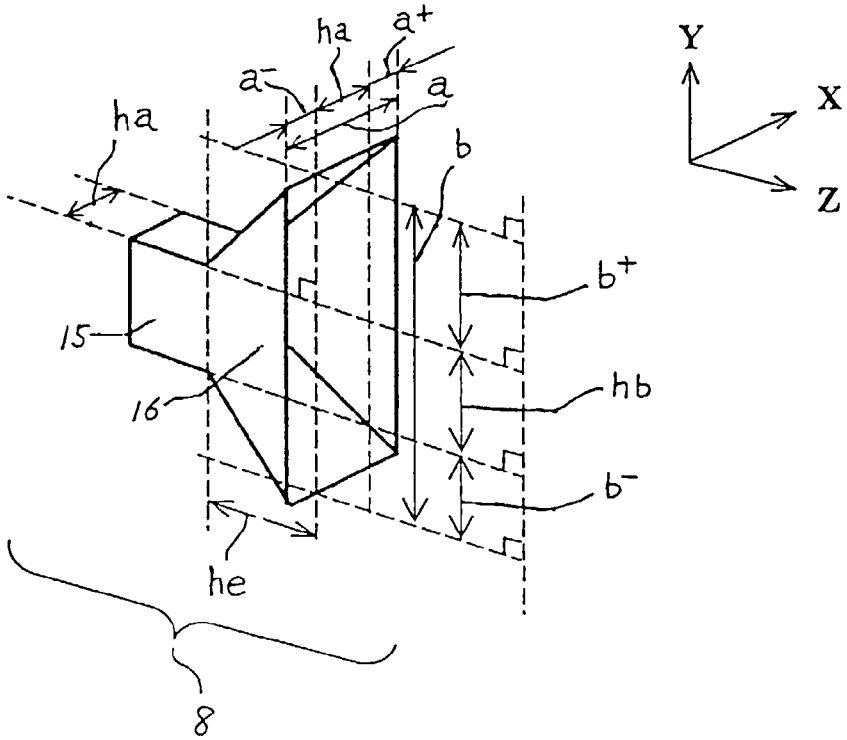
FIG. 2 is a perspective view showing the horn antenna according to Embodiment 1 of the invention.

FIG. 2 is a perspective view showing a structure of the horn antenna 8. The horn antenna 8 is comprised of a horn part 16 for radiating radio waves into space and a wave-guide part 15 for feeding radio waves to the horn part 16. The radio waves are fed from a radar sensor 7 in FIG. 1 to the wave-guide part 15. The wave-guide part 15 is rectangular in cross section so that diameter of the wave-guide part in X-axis direction is ha and diameter of the wave-guide part in Y-axis direction is hb.

The horn part 16 has a pyramidal configuration, in which an axial length is he and the wave-guide diameters ha and hb diverge linearly toward an opening diameter a in X-axis direction and an opening diameter b in Y axis direction respectively. The opening diameter a in X-axis direction of the horn part 16 has an opening configuration diverging by $a^+$ in +X direction and $a^-$ in −X direction establishing the wave-guide diameter ha as a center. In a case where $a^+ \neq a^-$, the opening has a configuration asymmetric in X-axis direction.

The opening diameter b in Y-axis direction of the horn part 16 has an opening configuration diverging by $b^+$ in +Y direction and $b^-$ in −Y direction establishing the wave-guide diameter hb as a center. In a case where $b^+ \neq b^-$, the opening has a configuration asymmetric in Y-axis direction.

Referring to FIG. 2, radio waves are fed from the radar sensor 7 to the wave-guide part 15 in the form of an electric field excited in X-axis direction and are radiated into free space through the horn part 16. Therefore, the radio waves radiated from the horn part 16 into free space take a form of linearly polarized waves.

Figure 3:
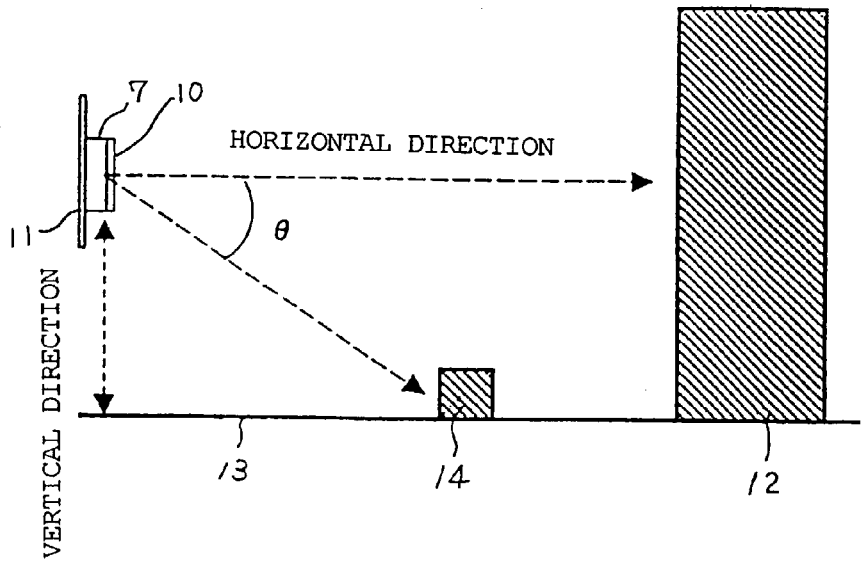
FIG. 3 is a schematic side view showing the on-vehicle radar sensor using the horn antenna of Embodiment 1.

FIG. 3 is a side view schematically showing a radio wave radar comprised of the horn antenna according to the invention mounted on a vehicle. The radar sensor 7 is fixed onto the vehicle 11 with a bracket or the like. In the radar sensor 7, the horn antenna 8 (not shown in FIG. 3) forming the radar sensor 7 radiates radio waves, the horn antenna 8 forming the radar sensor 7 receives an echo from a target 12 existing in a detection area of the radar sensor 7 through the radome 10 forming the radar sensor 7. In this manner, the radar sensor 7 detects the target 12 existing in the detection area of the radar sensor 7. Reference numeral 13 indicates the ground (road surface), and numeral 14 indicates a low obstacle (of a small height) lying on the ground.

Figure 4:
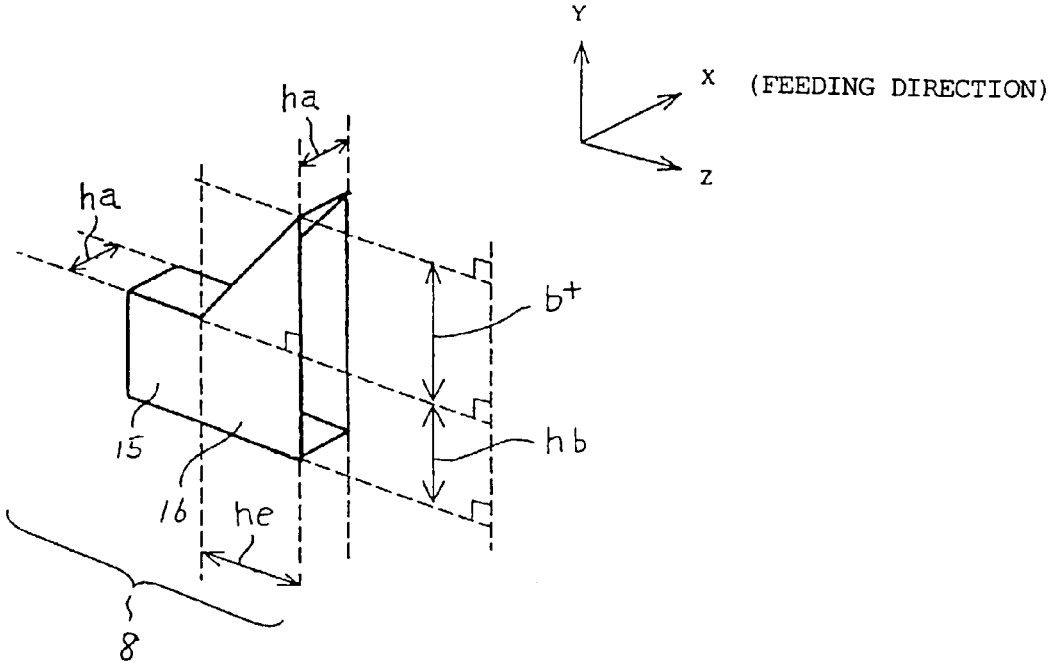
FIG. 4 is a perspective view showing the horn antenna according to Embodiment 1 used in measuring characteristics.
Figure 5:
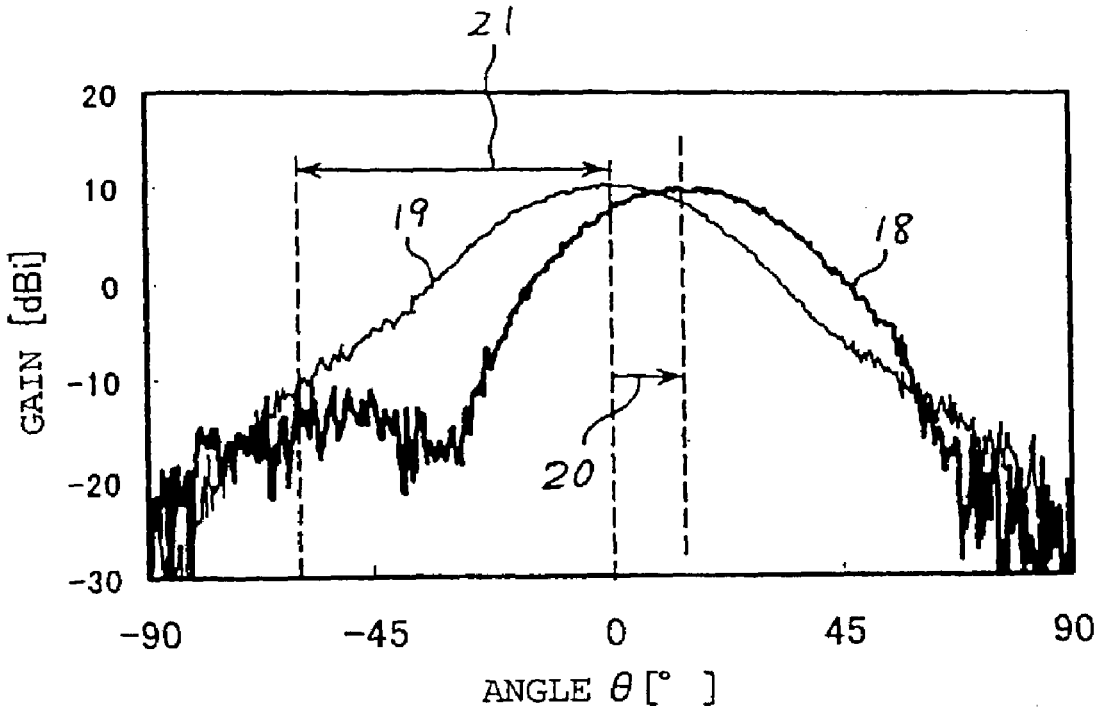
FIG. 5 is a graphic diagram showing measured values of radiation pattern characteristics when the horn antenna in FIG. 4. is used.

The horn antenna according to the invention is constructed and installed as described above. Now a horn antenna of which structure is shown in FIG. 4 is prepared and used to measure characteristics. FIG. 5 shows the measured characteristics. The horn antenna 8 shown in FIG. 4 has a divergent configuration symmetrical in X-axis direction and asymmetrical in Y-axis direction, and measured values 18 in H plane radiation pattern of the horn antenna 8 are shown in FIG. 5. Described hereinafter are dimensions of the mentioned horn antenna 8 shown in FIG. 4 and having a divergent configuration that is symmetrical in X-axis direction and asymmetrical in Y-axis direction. In this case, wavelength of the radio waves is $\lambda=C/f\times10^3$ [mm], (where: C [m/s] indicates the velocity of light, and f [Hz] indicates the frequency of the radio waves).

$$ha=0.36\times\lambda,\ hb=0.72\times\lambda,\ he=1.61\times\lambda$$

$$a=0.36\times\lambda,\ a^+=0,\ a^-=0$$

$$b=2.01\times\lambda,\ b^+=1.29\times\lambda,\ b^-=0$$

Figure 6:
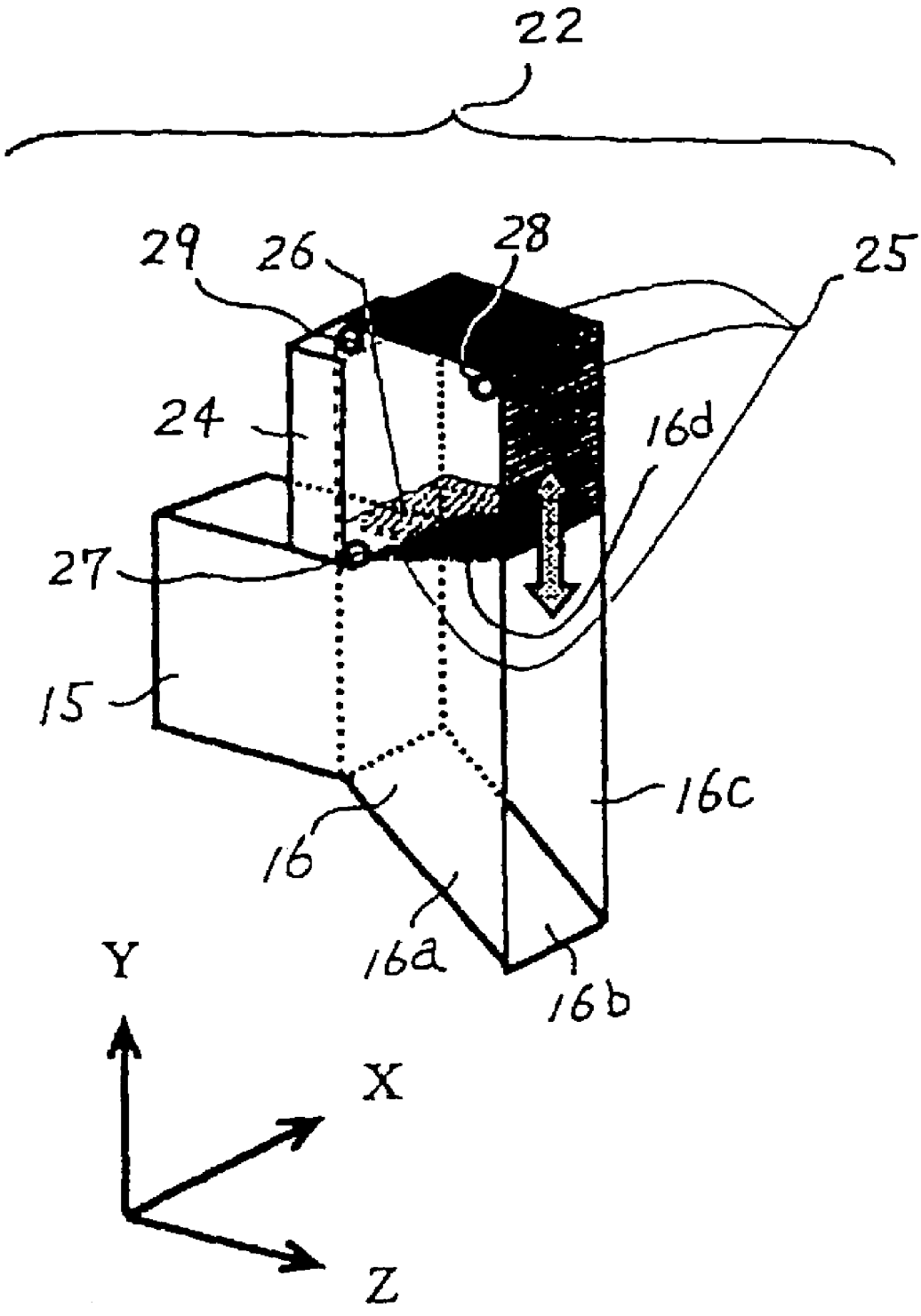
FIG. 6 is a perspective view showing a horn antenna according to Embodiment 2 of the invention.

For the purpose of comparison, H plane radiation pattern measured values 19 of a horn antenna having a divergent configuration symmetrical in both X-axis direction and Y-axis direction are shown in FIG. 6. Described hereinafter are dimensions of the mentioned horn antenna having a divergent configuration symmetrical in both X-axis direction and Y-axis direction and used in the comparison.

$$ha=0.36\times\lambda,\ hb=0.72\times\lambda,\ he=1.61\times\lambda$$

$$a=0.48\times\lambda,\ a^+=a^-=0.06\times\lambda$$

$$b=2.82\times\lambda,\ b^+=b^-=1.05\times\lambda$$

Referring to FIG. 5, the H plane radiation pattern 18 of the asymmetrical horn antenna 8 having the divergent configuration asymmetrical only in Y-axis direction is of a radiation pattern asymmetrical putting the 0 [deg.] as the axis. It is understood from FIG. 5 that, as compared with the H plane radiation pattern 19 of the symmetrical horn antenna having the divergent configuration symmetrical in both X-axis direction and Y-axis direction, the maximum radiation direction is offset in angle by an offset angle 20 toward a direction of $\theta>0$. It is also understood from FIG. 5 that, in the foregoing H plane radiation pattern 18, the gain in a downward angular range 21 of $-60<\theta<0$ [deg.] is reduced as compared with the foregoing H plane radiation pattern 19.

In this manner, by making the divergence asymmetrical in the axial direction of the horn antenna, it becomes possible to deviate the maximum radiation direction in radiation pattern of the foregoing horn antenna 8 from front ($\theta=0$) to another ($\theta\neq0$) and control the gain in a specific angular range.

In a case where the foregoing conventional horn antenna having the symmetrical configuration as shown by the characteristics 19 in FIG. 5 is used as a component for forming, for example, an on-vehicle radio wave radar, then reflected waves from the low obstacle 14 such as ground clutter are detected in addition to the detection of the target 12. On the other hand, in a case where the horn antenna 8 having the asymmetrical configuration in vertical direction as shown by the characteristics 18 in FIG. 5 is used as a component for forming an on-vehicle radar, it has been experimentally acknowledged that reflected waves from the low obstacle 14 such as ground clutter are reduced and the target 12 is detected with high accuracy.

As described above, using the horn antenna 8 having the asymmetrical configuration according the invention makes it possible to reduce reflected waves from the low obstacle such as ground clutter, and unlike the conventional horn antenna, it is not necessary to dispose any shielding member projecting downward at the front of the radar sensor, mount any radar sensor or any radar antenna upward to the sky on the vehicle, or enlarge the diameter of the opening of the radar antenna to narrow the radiation pattern in vertical direction.

In a case where the conventional horn antenna having the symmetrical configuration is used as a component for forming, for example, an on-vehicle radio wave radar, since the foregoing symmetrical horn antenna has a radiation pattern symmetrical in a horizontal plane, the maximum detection direction of the radar in horizontal plane depends on the mounting angle in horizontal plane at which the foregoing radar sensor is mounted on the vehicle. If a desired detection area has a configuration asymmetrical with respect to the front of the foregoing radar sensor, it is necessary to optimize the mounting angle itself in horizontal plane at which the foregoing radar sensor is mounted on the vehicle. On the other hand, in a case where the horn antenna 8 having the configuration asymmetrical in horizontal direction is used as a component for forming an on-vehicle radio wave radar, the foregoing asymmetrical horn antenna 8 itself has a radiation pattern asymmetrical in a horizontal plane, and therefore it is possible to achieve an on-vehicle radio wave radar having a desired detection area without changing the mounting angle in horizontal plane at which the foregoing radar sensor is mounted on the vehicle.

Embodiment 2

FIG. 6 is a perspective view showing an external appearance of an asymmetrical horn antenna provided with a divergence varying mechanism according to the invention. In FIG. 6, numeral 15 is a feeding wave-guide part, numerals 16*a* to 16*d* are four sidewalls extending from an end portion of the wave-guide part 15 and forming the horn part 16. Among the four sidewalls, the sidewalls 16*a* to 16*c* are stationary sidewalls, and the remaining sidewall 16*d* is a moving sidewall disposed between the stationary sidewalls 16*a* and 16*c*. An angle of inclination with respect to the axis of the horn antenna is adjustable by means of the antenna divergence varying mechanism.

The antenna divergence varying mechanism is comprised of a flexible strip conductor film 25 applied with a specific tension, a moving plate 26 supporting the strip conductor film 25, and an actuator 24 for displacing the moving plate 26 in Y-direction (or X-direction). The strip conductor film 25 has an end secured to an end shaft 27 of the wave-guide part 15 and is rolled on a roll 29 through an end of the moving plate 26 and a roll 28, thus the roll 29 applying a specific tension to the conductor film 25. The moving plate 26 of which end reaches an opening face of the horn part 16 is moved up and down by the actuator 24 as indicated by the arrow, and in such movement, the end in contact with the conductor film 25 slides on the conductor film 25.

In the horn antenna of the foregoing structure, to adjust increasingly the divergence of the moving sidewall 16*d* composed of the foregoing strip conductor film 25 with respect to the axis, the moving plate 26 is moved upward by the actuator 24. As a result, the portion where the strip conductor 25 is in contact with the end of the moving plate 26 is displaced upward, thereby the divergence being increased. On the other hand, to reduce the divergence of the moving sidewall 16*d* to the axis, the moving plate 26 is moved downward by the actuator 24. In this manner, the strip conductor 25 is rolled up or drawn out by the roll 29 and is kept at all times under a specific tension through the foregoing operation. As described above, the moving plate 26 displaced in Y-direction (or X-direction) by the actuator 24 changes the bending angle of the strip conductor film 25 at the end of the wave-guide part thereof, and this makes it possible to continuously change the divergence of the antenna opening.

In a case where the conventionally known symmetrical horn antenna is used as a component for forming, for example, an on vehicle radio wave radar, when fixing the radar at one place, detection area of the target 12 is also fixed to only one detection area. On the other hand, in case of using the horn antenna 22 provided with the antenna divergence varying mechanism according to this embodiment, vertical or horizontal divergence of the antenna is variable, and it is therefore possible to change the target detection area to any of plural detection areas according to the situation (FIG. 6 shows a case where only the divergence on one side in the vertical direction is variable). Thus, target detection area may be changed real time so as to cover the area difficult or impossible for the driver to see on the basis of information concerning various conditions of the vehicle including mirror angle, vehicle speed, yaw angle, etc. and information concerning the position, posture, and gaze of the driver.

In a case where only one set of the conventionally known symmetrical horn antenna is used as a component for forming, for example, an on-vehicle radio wave radar, it is not possible to obtain angle information concerning the target on the basis of a received echo. On the other hand, in case of using the horn antenna having the asymmetrical and variable configuration according to this embodiment as a component of an on-vehicle radio wave radar, it is possible to monitor any direction from which an echo arrives on the basis of information of the antenna divergence controlled by the actuator.

Furthermore, in the case where the horn antenna having the asymmetrical and variable configuration according to this embodiment is used as a component for forming an on-vehicle radio wave radar, divergence of the asymmetrical horn antenna is sequentially optimized so that a maximum echo receiving level is attained. As a result, it is possible to follow up and scan any target and stably detect the target.

Additional features and advantages of the radar horn antenna according to the invention are hereinafter collectively described.

As a first additional feature, in the radar horn antenna according to claim 1 of the invention, divergence in axial direction of at least one of four sidewalls forming the horn part of the radar horn antenna is adjustable.

As a result of including such a feature, vertical or horizontal divergence of the antenna is variable, and it is possible to change a target detection area to any of plural detection areas depending upon the situation.

As a second additional feature, in the radar horn antenna according to claim 3 of the invention, the horn antenna is provided with means for applying a specific pressure to the conductor film thereby absorbing deflection of the conductor film.

As a result of including such a feature, it is easy to adjust divergence of the horn part of the antenna.

While the presently preferred embodiments of the present invention have been shown and described, it is to be understood these disclosures are for the purpose of illustration and that various changes and modifications may be made without departing from the scope of the invention as set forth in the appended claims.

What is claimed is:

1. A radar horn antenna comprising:

a horn part with a cross-section that is divergent in an axial direction of the horn antenna and which is formed in a pyramidal shape and asymmetrically with respect to at least one of a primary and a lateral direction of the axis of the horn antenna, wherein a maximum radiation direction in a radiation pattern of the horn antenna is angularly controlled, and wherein an amount of divergence of at least one of four sidewalls of said horn part of the radar horn antenna is adjustable by pivoting the at least one sidewall either towards or away from the axial direction.

2. The radar horn antenna of claim 1, further comprising a plate that is movable so as to alter the amount of divergence.

3. A radar horn antenna comprising a horn part including four sidewalls communicating with a feeding wave-guide tube part, wherein at least one of the four sidewalls comprises a flexible conductor film which is configured so that divergence of the at least one of the four sidewalls in an axial direction with respect to the horn antenna is adjustable by changing a bending angle of the flexible conductor film.

4. The radar horn antenna according to claim 3, wherein the horn antenna further comprises means for applying pressure to the conductor film to absorb deflection of the conductor film.

5. A radar horn antenna comprising two sets of opposing diverging sidewalls, wherein at least one of the two sets of opposing sidewalls comprises a first and second sidewall with different respective amounts of divergence, and wherein at least one of the first and second sidewalls is a moving sidewall, and comprises a flexible conductor strip.

6. The radar horn antenna of claim 5, further comprising a moving plate operable to change the divergence of the at least one of the first and second sidewalls.

7. The radar horn antenna of claim 6, wherein the flexible conductor strip is fixed on one end thereof and rolled at another end thereof and a length of the flexible conductor strip is extended or retracted based on movement of the moving plate.

8. The radar horn antenna of claim 5, wherein the flexible conductor strip is driven such that it is moved inwardly and outwardly to change the divergence of the at least one of the first and second sidewalls comprising the flexible conductor strip.

* * * * *